United States Patent [19]

Achiel

[11] Patent Number: 4,906,000

[45] Date of Patent: Mar. 6, 1990

[54] AUTOMATIC SKITTLE GAME

[76] Inventor: Verstraeten Achiel, Passtraat 211, 2700 Sint Niklaas, Belgium

[21] Appl. No.: 349,683

[22] Filed: May 10, 1989

[30] Foreign Application Priority Data

May 9, 1988 [BE] Belgium ..... 8800515

[51] Int. Cl.[4] ..... A63D 1/00

[52] U.S. Cl. ..... 273/41; 273/54 C

[58] Field of Search ..... 273/37, 38, 41, 45, 273/54 C

[56] References Cited

U.S. PATENT DOCUMENTS

| | | | |
|---|---|---|---|
| 1,499,748 | 7/1924 | Papouchis | 273/41 X |
| 1,904,033 | 4/1933 | Schulze et al. | 273/41 |
| 2,499,470 | 3/1950 | Duncan | 273/37 UX |
| 3,037,299 | 6/1962 | Telford | 273/37 X |
| 3,111,315 | 11/1963 | Vermeulen | 273/37 |

*Primary Examiner*—Anton O. Oechsle

*Attorney, Agent, or Firm*—William A. Drucker

[57] ABSTRACT

The invention is for an automatic skittle game equipped with a coin or token mechanism and in which the skittles have different point values which are registered automatically on a scoreboard. The automatic skittle game consists primarily of a combination of a coin or token mechanism for the operation of the automatic skittle game, a rollable skittle ball, a guide path for guiding the skittle ball, a number of skittles with individual values in points which are set up on both sides of the guide path, said skittles being each mounted on a rocker, a mechanism for blocking and clearing the guide path, a mechanism for restoring to the vertical position the skittles with rockers bowled-over by the skittle ball when this skittle ball rolls back, an electrical scoreboard for recording the value in points of the bowled-over skittles, and a contact for each rocker and skittle which contacts of the bowled-over skittles close an electrical circuit to the scoreboard.

7 Claims, 4 Drawing Sheets

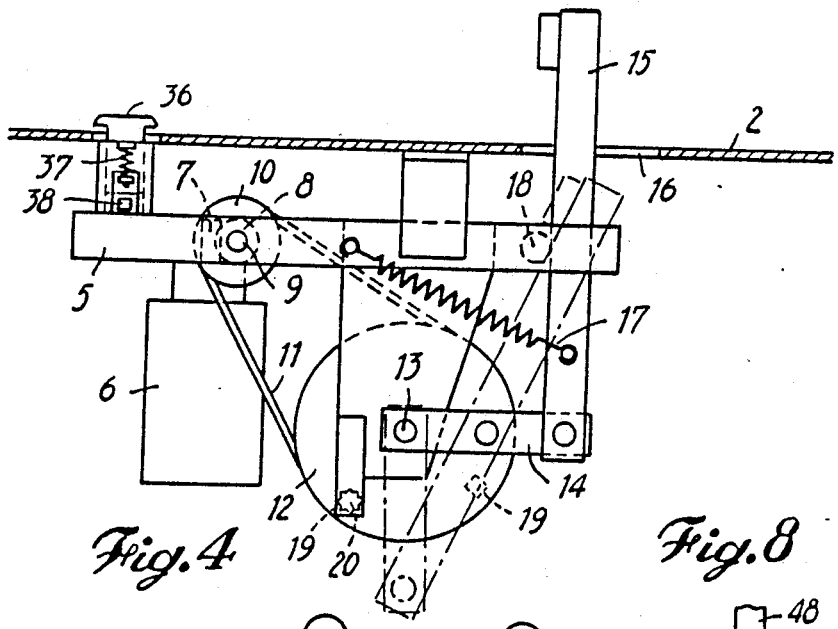
Fig. 4
Fig. 8
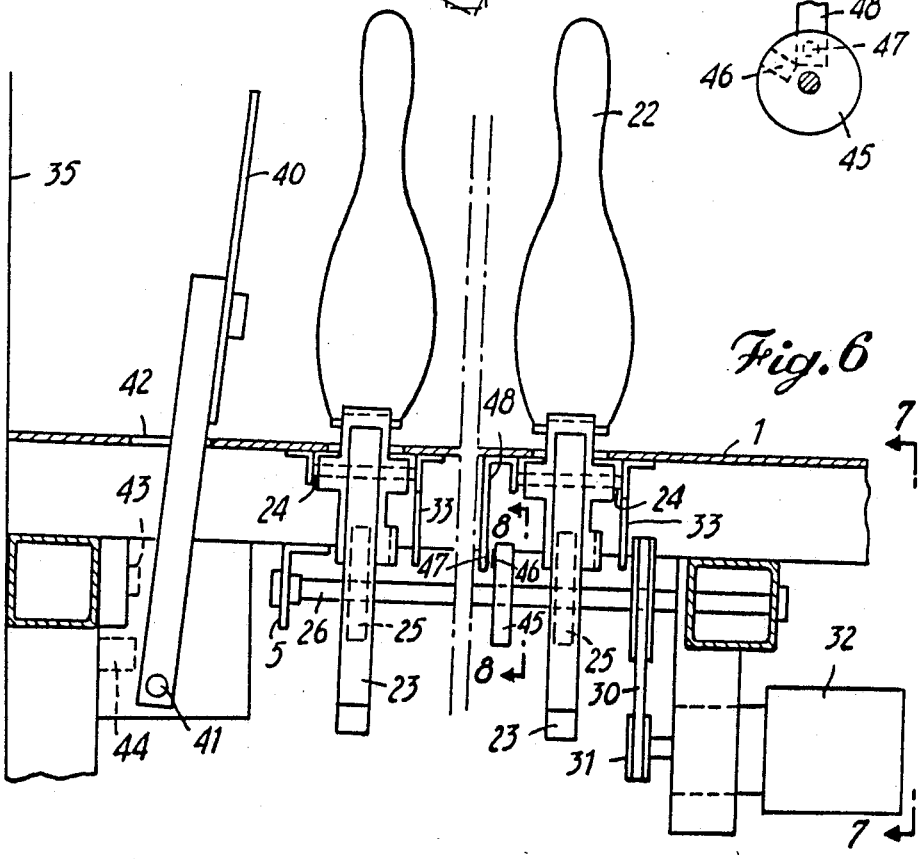
Fig. 6

AUTOMATIC SKITTLE GAME

The invention is for an automatic skittle game equipped with a coin or token mechanism and in which the skittles have different point values which are registered automatically on a scoreboard for the skittles knocked over by the skittle ball, in which a mechanism is provided for the automatic return to the vertical of the fallen skittles and a mechanism for blocking the skittle ball guide path when the coin or token mechanism is not activated.

An advantage of this automatic game is that it works virtually entirely automatically.

A more detailed description of a chosen embodiment is given below by way of example without being in any way limitative. This description refers to the attached drawings, where:

FIG. 4 shows an enlarged longitudinal section along the line IV—IV in FIG. 2;

FIG. 6 shows an enlarged longitudinal section along the line VI—VI in FIG. 2;

FIG. 8 shows a transverse section along the line VIII—VIII in FIG. 6;

Figure 1:
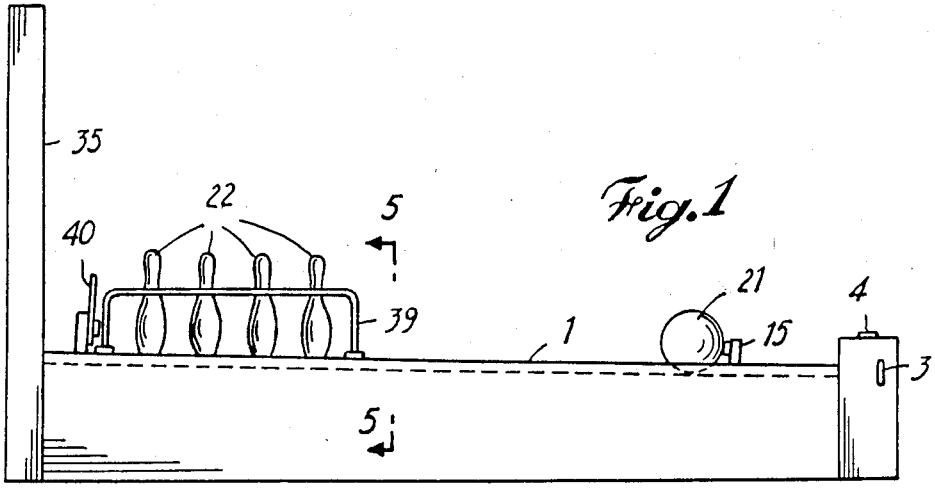
FIG. 1 shows a side elevation of the automatic skittle game.
Figure 2:
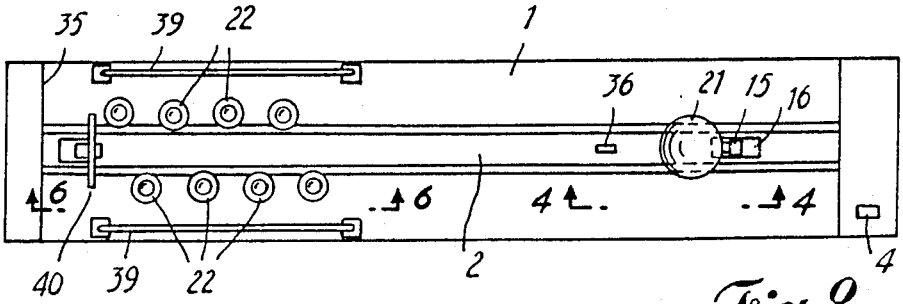
FIG. 2 shows a plan view.
Figure 3:
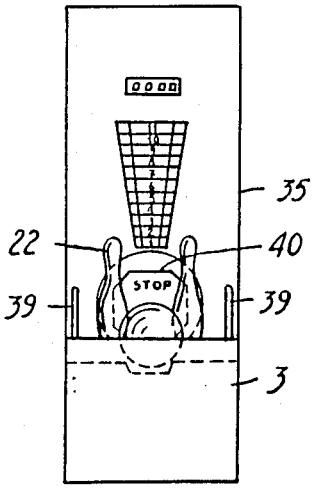
FIG. 3 shows a front elevation.
Figure 5:
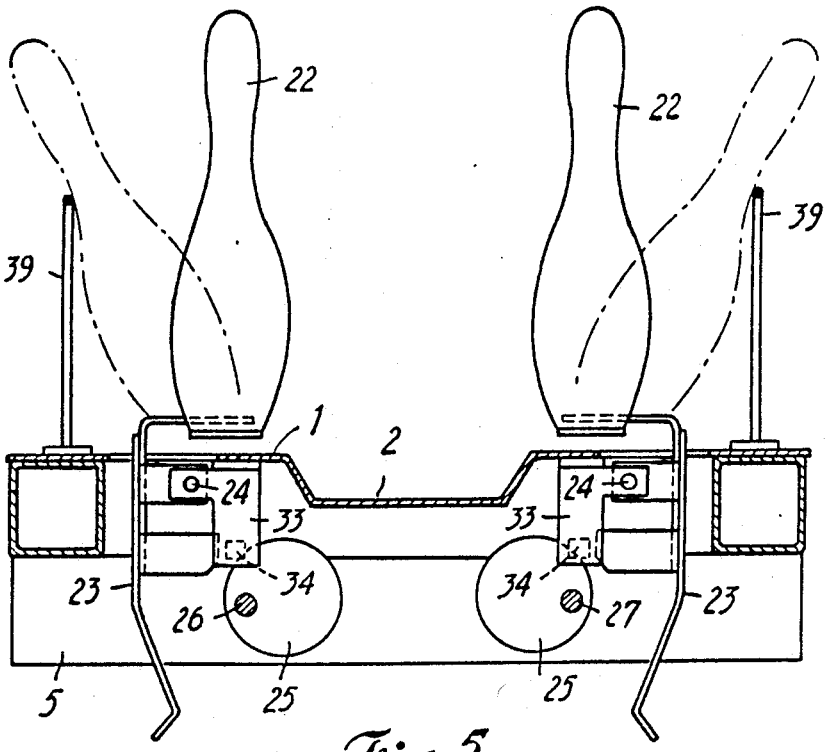
FIG. 5 shows an enlarged transverse section along the line V—V in FIG. 1.
Figure 7:
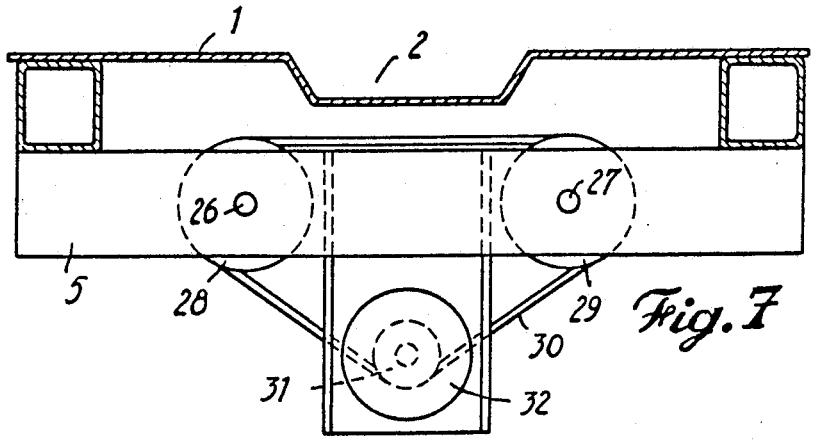
FIG. 7 shows a transverse section along the line VII—VII in FIG. 6.
Figure 9:
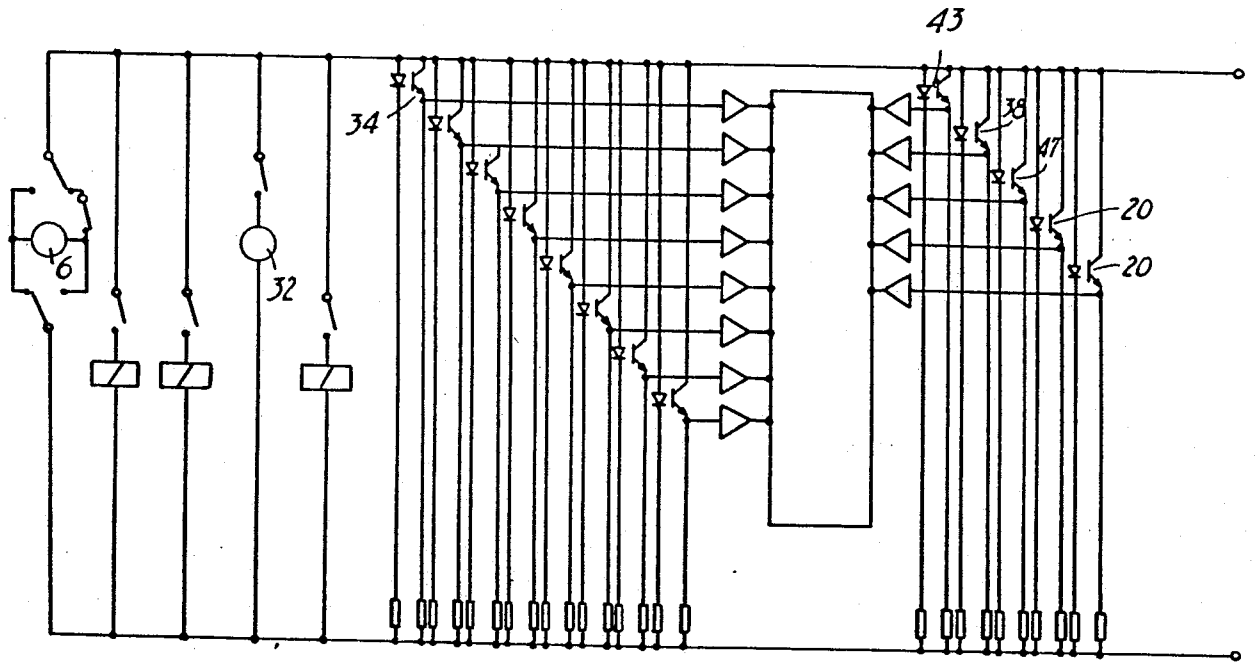
FIG. 9 shows the electrical wiring diagram of the automatic skittle game.

In these figures it can be seen that the automatic skittle game has an oblong playing surface 1 the gradient of which can be adjusted by means of any known mechanism whatsoever (not illustrated). There is a groove-shaped guide path 2 provided with by preference a reverse trapezium-shaped section in the playing surface which by preference runs over the entire length of the playing surface. An automatic coin or token mechanism with a slot 3 for the insertion of a coin or playing token is mounted at the front of the playing surface which mechanism includes a starting button 4 for starting the automatic skittle game. Under the playing surface 1 is a frame 5 composed of angle iron sections and panels on which an electrical motor 6 is suspended. A wormscrew 7 is mounted on the shaft of this motor which meshes with a wormgear 8 which is fixed to a shaft with bearings in the frame 5. A toothed-belt pulley 10 is mounted on this shaft over which a toothed driving belt 11 runs and which also runs over a toothed-belt pulley 12 mounted on a shaft 13 which is also mounted in bearings in the frame. A crank 14 is mounted on the shaft 13 which is also fixed to the belt pulley 12 and which is connected by a swivel to a flat 15 which passes through a slot 16 provided in the guide path and which can be moved by the electrical motor 6. A tension spring 17 installed between the flap 15 and the frame 5 holds the arm against a supporting roller 18 mounted in the frame 5. On each side of the toothed-belt pulley 12 photocell detectors 19 are fitted which stagger with respect to each other and work in conjunction with a photocell switch 20 mounted on the frame 5, which allows the motor 6 to be started or stopped according to the position of the toothed-belt pulley 12 and the flap 15. When the flap is in the extended position the rollable skittle ball 21 which fits partially in the guide path 2 is prevented from being rolled over the entire playing surface 21. Set up at the back of the playing surface and on each side of the guide path 2 there are a series of skittles 22 which each have their own value in points which by preference increases towards the back and which are affixed to the rockers 23 each of which is mounted on a spindle 24 borne by the frame. The free end of each rocker works in conjunction with a cam 25. The cams of each row of rockers with skittles are mounted on a common shaft 26 and 27 mounted on bearings in the frame 5. On each shaft 26 and 27 a toothed-belt pulley respectively 28 and 29 is fastened, which is driven by a toothed driving belt 30 which also runs over a toothed-belt pulley 31 mounted on the shaft of an electrical motor 32 suspended on the frame 5. Each rocker 23 works in conjunction with a fixed support 33 on which a photocell switch 34 is fastened for the registration on the electrical scoreboard 35 of the value in points of a skittle touched and bowled over by the skittle ball. A pressure switch 36 is located in the guide path which is pulled out of the guide path 2 by a tension spring 37 in its highest position. This pressure switch operates in conjunction with a photocell switch 38 so that when the skittle ball 21 rolls back and it is pressed down, the electrical motor 32 is started for the restoration of the skittles 22 to the vertical. In order to prevent the knocked down skittles 22 from restoring themselves to the vertical, a spring support 39 operates in conjunction with each row of skittles which holds the bowled-over skittles in the slanting position. At the end of the guide path 2 a cushion plate 40 is provided which can on the one hand swivel on a spindle 41 and on the other hand passes through a slot 42 provided in the guide path 2. This cushion plate operates in conjunction with a contact 43 which when the skittle ball 21 touches the cushion plate and depresses the cushion plate, records a zero total of points on the electrical scoreboard 34. A striker 44 ensures the swivel position of the cushion plate is limited. A disc 45 is mounted on the shaft 27 and to which a photocell contact 46 is affixed which operates in conjunction with a photocell contact 47 attached to a support 48, for the interruption of the electrical circuit of the electrical motor 32.

In order to play the automatic skittle game, a coin or token is inserted into the slot 3, whereupon by pressing the starting button 4 the electrical motor 6 is started. As a result the wormscrew 7 mounted on the shaft of the motor starts to drive with a rotating motion the wormgear 8 mounted on shaft 9 and to which the toothed-belt pulley 10 is fastened. This toothed-belt pulley drives the toothed-belt pulley 12 by means of the toothed-belt 11, as a result of which the crank 14 mounted on the shaft 13 and the belt pulley 12 pulls the flap 15 down out of the guide path 2 (shown by the dot and dash line in FIG. 4). When the photocell detector 19 mounted on the belt pulley 12 overlaps the photocell switch 20, the circuit of the electrical motor 6 is interrupted and the motor will stop so that the flap 15 remains in the position as assumed. The skittle ball 21 can now be rolled freely over the clear guide path 2. When the first skittle 22 is now struck and together with its rocker 23 tips around the spindle 24 so that it rests against the spring support 39, the rocker comes into contact with the photocell detector 34, so that the points value of the skittle is recorded on the scoreboard 35. The same takes place when each subsequent skittle is bowled over, so that the total points value is recorded on the electrical scoreboard 35 in accordance with the number of fallen skittles. At the same time the photocell detector 34 of the first rocker switches the electrical motor 6 on, so that this again swivels the flap 15 outwards by means of the crank 14, so that the former once again blocks the guide path 2 and play cannot be continued. One of the photocell detectors 19 on the belt pulley 12 overlaps the photocell switch 20 stopping the electrical motor. A known mechanism not shown here can ensure that the electrical motor is only started after a certain credit level is exceeded. When however the rolled skittle ball 21 is too fast and touches the cushion plate 40, this causes the spindle 41 to swivel and to depress contact 43. In that case the number of points already registered on the scoreboard 35 are wiped off and a disc on the scoreboard is illuminated indicating no points. When subsequently the skittle ball 21 rolls back, the cushion plate 40 falls back under its own weight into the starting position and the skittle ball rolls over the pressure switch 36, which is then depressed. This causes the photocell detector 38 to start the electrical motor 32. The shafts 26–27 with the cams 25 are then driven round through the intermediary of the belt pulleys 28, 29, 31 and the driving belt 30, so that the rockers 23 with the skittles 21 mounted on them and tipped against the cams are restored to the vertical position. When upon restoring the skittles the shaft 27 has turned the disc 45 to such an extent that the photocell detector 46 overlaps the photocell switch 47, the circuit of the electrical motor 42 is interrupted and the entire skittle mechanism is stopped. The automatic skittle game is then ready for the next game. The entire device is controlled by a micro-processor which makes it possible to create various possible games.

It goes without saying that the form and dimensions of the components described above may differ and that some of these components may be replaced by others with the same purpose. At the same time other parts can be added to the automatic game which would improve its practical operation.

I claim:

1. Automatic skittle game, comprising in combination a coin or token mechanism for the operation of the automatic skittle game, a rollable skittle ball, a guide path for guiding the skittle ball, a number of skittles with individual values in points which are set up on both sides of the guide path, said skittles being each mounted on a rocker, a mechanism for blocking and clearing the guide path, a mechanism for restoring to the vertical position the skittles with rockers bowled over by the skittle ball when this skittle ball rolls back, an electrical scoreboard for recording the value in points of the bowled over skittles, and a contact for each rocker and skittle which contacts of the bowled-over skittle close an electrical circuit to the scoreboard.

2. Automatic skittle game as defined in claim 1, in which the guide path is groove-shaped and has a reverse trapezium-shaped section.

3. Automatic skittle game as defined in claim 1, in which the mechanism for blocking and clearing the guide path consists of an electrical motor controlled by the automatic coin mechanism, a wormscrew and wormgear transmission, a belt transmission, a crank mechanism with flap mounted on the shaft of the belt transmission which flap is movable through a slot provided in the guide path and serves to block the guide path, a support and tension spring for pulling the flap against the support, and contacts provided between the belt transmission and the frame of the automatic mechanism for controlling the circuit of said electrical motor.

4. Automatic skittle game as defined in claim 1, in which the mechanism for restoring the skittles to the vertical consists of two shafts with respectively bearings under each side of the guide path, an electrical motor with a belt transmission for rotating the shafts, a cam fastened to each shaft and for each rocker with skittle for restoring the tipped rockers with skittle to the vertical, a pressure switch in the guide path which is depressed by the returning skittle ball and which controls the circuit for starting said electrical motor, and a disc mounted on one of said shafts provided with a contact working in conjunction with a fixed contact for opening the electrical circuit of said electrical motor in order to stop the same when the disc is in a particular position.

5. Automatic skittle game as defined in claim 1, in which each rocker works in conjunction with a contact closing in the tipped state of the rocker with skittle a circuit to the scoreboard for registering the obtained value in points; the contact of the first rocker with skittle controls the electrical circuit of an electrical motor forming part of the mechanism for blocking and clearing the guide path.

6. Automatic skittle game as defined in claim 1, in which at the end of the guide path a cushion plate is mounted swivelling on a spindle which plate when it is pushed back by the skittle ball operates in conjunction with a contact closing an electrical circuit to the scoreboard and recording a zero score on same.

7. Automatic skittle game as defined in claim 1, in which the outside edge of each row of skittles operates in conjunction with a spring support absorbing the shock of the bowled over skittles and holding these skittles in position.

* * * * *